US011267631B2

(12) United States Patent
Holford

(10) Patent No.: US 11,267,631 B2
(45) Date of Patent: Mar. 8, 2022

(54) PACK FOR TOBACCO INDUSTRY PRODUCTS

(71) Applicant: British American Tobacco (Investments) Limited, London (GB)

(72) Inventor: Steven Holford, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 16/965,131

(22) PCT Filed: Jan. 21, 2019

(86) PCT No.: PCT/GB2019/050155
§ 371 (c)(1),
(2) Date: Jul. 27, 2020

(87) PCT Pub. No.: WO2019/145690
PCT Pub. Date: Aug. 1, 2019

(65) Prior Publication Data

US 2021/0039878 A1 Feb. 11, 2021

(30) Foreign Application Priority Data

Jan. 26, 2018 (GB) ..... 1801343

(51) Int. Cl.
*B65D 75/58* (2006.01)
*B65D 85/10* (2006.01)

(52) U.S. Cl.
CPC ... *B65D 75/5838* (2013.01); *B65D 85/10568* (2020.05)

(58) Field of Classification Search
CPC .... B65D 75/58; B65D 75/5838; B65D 85/10; B65D 85/1045; B65D 85/1056; B65D 85/10568; B65D 85/1081
(Continued)

(56) References Cited

U.S. PATENT DOCUMENTS 5,363,955 A 11/1994 Fleenor
5,478,011 A 12/1995 Pham
(Continued)

FOREIGN PATENT DOCUMENTS

DE 202015106399 U1 1/2017
DE 102015013734 A1 4/2017
(Continued)

OTHER PUBLICATIONS

British Search Report for corresponding application GB1801342.5; dated Jul. 17, 2018.
(Continued)

*Primary Examiner* — Bryon P Gehman
(74) *Attorney, Agent, or Firm* — Cantor Colburn LLP

(57) ABSTRACT

A pack (30) comprising a base (3) containing a group of tobacco industry products (4) wrapped in a barrier material (5) that comprises a removable section (5*a*) to define an extraction opening (8) for the removal of tobacco industry products is disclosed. The pack has lid (2) attached to the base for rotation between open and closed positions and a lid front wall (37) having an inner surface (45) and a lid front wall flap (46) having front and rear (46*b*) faces. The lid front wall flap is folded relative to the lid front wall about a fold along a lower edge (44) of the lid front wall and comprises a first portion (47) extending from the fold. The rear face of the lid front wall flap formed by the first portion is attached to said inner surface of the lid front wall. The lid front wall flap also comprises an intermediate portion (48) extending from, and which is configured to fold relative to, the first portion, and a second portion (50) extending from the intermediate portion which is folded relative to the intermediate portion to expose the rear face of the lid front wall flap formed by the second portion. A label (9) is attached to the removable section of the barrier material and to the lid so
(Continued)

that, when the lid is rotated towards the open position, the removable section is lifted to open the extraction opening. The label is attached to the rear face of the lid front wall flap is formed by the second portion.

18 Claims, 9 Drawing Sheets

(58) Field of Classification Search
USPC ..... 206/245, 264, 268
See application file for complete search history.

(56) References Cited

U.S. PATENT DOCUMENTS

| | | | |
|---|---|---|---|
| 5,934,461 | A | 8/1999 | Fleenor |
| 9,499,331 | B2 | 11/2016 | Seyfferth De Oliveira |
| 9,815,613 | B2 | 11/2017 | Seyfferth De Oliveira |
| 10,633,169 | B2 * | 4/2020 | Buse ..... B65D 85/10568 |
| 2008/0202681 | A1 | 8/2008 | Spatafora |
| 2014/0374290 | A1 | 12/2014 | Seyfferth De Oliveira |
| 2015/0021219 | A1 | 1/2015 | Seyfferth De Oliveira |
| 2015/0374033 | A1 | 12/2015 | Pilzecker |
| 2015/0375923 | A1 | 12/2015 | Pilzecker |
| 2017/0113865 | A1 | 4/2017 | Swede |
| 2017/0203910 | A1 | 7/2017 | Buse |

FOREIGN PATENT DOCUMENTS

| | | | |
|---|---|---|---|
| DE | 102015016456 | A1 | 6/2017 |
| DE | 102016003737 | A1 | 10/2017 |
| EP | 0647571 | A1 | 4/1995 |
| EP | 3009374 | A1 | 4/2016 |
| GB | 461794 | | 2/1937 |
| JP | 1149151 | A | 2/1999 |
| KR | 1020140022366 | A | 2/2014 |
| WO | 2007093288 | A1 | 8/2007 |
| WO | 2008142540 | A1 | 11/2008 |
| WO | 2012049701 | A2 | 4/2012 |
| WO | 2012095135 | A1 | 7/2012 |
| WO | 2012095372 | A1 | 7/2012 |
| WO | 2016059366 | A1 | 4/2016 |
| WO | 2016083608 | A1 | 6/2016 |
| WO | 2016087819 | A1 | 6/2016 |
| WO | 2016087826 | A1 | 6/2016 |
| WO | 2016120674 | A1 | 8/2016 |
| WO | 2016166692 | A1 | 10/2016 |
| WO | 2017072606 | A1 | 5/2017 |
| WO | 2017072730 | A1 | 5/2017 |
| WO | 2017072731 | A1 | 5/2017 |
| WO | 2017097999 | A1 | 6/2017 |
| WO | 2018002033 | A1 | 1/2018 |

OTHER PUBLICATIONS

British Search Report for corresponding application GB1801347.4; dated Jul. 17, 2018.
British Search Report for corresponding application GB1802166.7; dated Jun. 26, 2018.
International Search Report for corresponding application PCT/GB2019/050135 filed Jan. 18, 2019; dated Apr. 4, 2019.
International Search Report for corresponding application PCT/GB2019/050154 filed Jan. 21, 2019; dated May 16, 2019.
International Search Report for corresponding application PCT/GB2019/050155 filed Jan. 21, 2019; dated Mar. 21, 2019.
Written Opinion for the International Searching Authority for corresponding application PCT/GB2019/050135 filed Jan. 18, 2019; dated Apr. 4, 2019.
Written Opinion of the International Searching Authority for corresponding application PCT/GB2019/050154 filed Jan. 21, 2019; dated May 16, 2019.
Written Opinion of the International Searching Authority for corresponding application PCT/GB2019/050155 filed Jan. 21, 2019; dated Mar. 21, 2019.

* cited by examiner

PACK FOR TOBACCO INDUSTRY PRODUCTS

TECHNICAL FIELD

The present invention relates to a pack, and particularly to a hinged-lid pack for tobacco industry products. The invention also relates to a method of packaging a group of tobacco industry products, and to a blank for forming a package for a group of tobacco industry products.

BACKGROUND

Packs for tobacco industry products, such as smoking articles, including cigarettes, typically include an outer carton made from cardboard which is folded to form a base and a hinged-lid. An inner frame may be attached to the base so that it protrudes from the base so that it is received in the lid when the lid is closed.

The pack includes a bundle of tobacco industry products, such as smoking articles, received in the base and protruding into the lid, when closed. The bundle may comprise a group of smoking articles wrapped in a flexible barrier layer that has a removable section. A flexible label is attached to the removable section and to the lid so that, when the lid is rotated into its open position, the removable section is lifted together with the flexible label to form an extraction opening through which smoking articles may be removed from the pack.

SUMMARY OF THE INVENTION

In accordance with the embodiments described herein, there is provided a pack comprising a base containing a group of tobacco industry products wrapped in a barrier material that comprises a removable section to define an extraction opening for the removal of tobacco industry products; a lid attached to the base for rotation between open and closed positions and comprising a lid front wall having an inner surface and a lid front wall flap having front and rear faces, the lid front wall flap being folded relative to the lid front wall about a fold along a lower edge of the lid front wall, the lid front wall flap comprising a first portion extending from said fold, the rear face of the lid front wall flap formed by the first portion being attached to said inner surface of the lid front wall, the lid front wall flap also comprising an intermediate portion extending from, and which is configured to fold relative to, the first portion, and a second portion extending from the intermediate portion which is folded relative to the intermediate portion to expose the rear face of the lid front wall flap formed by the second portion, a label being attached to the removable section of the barrier material and to the lid so that, when the lid is rotated towards the open position, the removable section is lifted to open the extraction opening; wherein the label is attached to rear face of the lid front wall flap formed by the second portion.

The first, intermediate, and second portions of the lid front wall flap may be integrally formed. The intermediate portion may be separated from each of the first and second portions by a fold-line.

Each of the fold-lines are preferably parallel, and may be parallel to a fold about which the lid rotates between its open and closed positions.

A height of the intermediate portion may be less than a height of the first or second portions, extending in a direction between the fold lines.

The intermediate portion may extend from the first portion and lies against the inner surface of the lid when the lid is in a closed position.

The second portion may extend between the first and intermediate portions, and the wrapped bundle, when the lid is in its closed position, such that the front face of the lid front wall flap formed by the second portion abuts the front face of the lid front wall flap formed by the first and intermediate portions and the rear face of the lid front wall flap formed by the second portion faces the wrapped bundle.

The pack may comprise a tongue cut from the intermediate portion and extending from the second portion such that the tongue remains in a plane of the second portion upon folding of the intermediate portion relative to the second portion upon initial opening of the lid.

The tongue may be cut from the intermediate portion so that it extends for only part of the height of the intermediate portion extending in a direction between the fold lines.

Alternatively, the tongue may be cut from the intermediate portion so that it extends for the full height of the intermediate portion and divides the intermediate portion into two sections separated by the tongue.

The cut may be U-shaped.

A free edge of the second portion may be spaced from the lower edge of the lid front wall in a direction extending in a plane of the lid front wall when the lid is in the closed position.

A line of weakness may extend between the removable section and the remainder of the barrier layer that breaks when the lid is rotated into its open position.

The label may have a peripheral edge that extends beyond the removable section to overlap the barrier layer surrounding the removable section, the peripheral edge being adhered to the barrier layer with re-stick adhesive.

The barrier material may be a multi-layered laminate material. In this case, the label may be formed from a layer of the multi-layered laminate.

The base and lid may be integrally formed from a foldable board material, such as cardboard.

In accordance with another embodiment of the invention, there is provided a method of packaging a wrapped bundle of tobacco industry products in a container that comprises a base and a lid, and in which a label is attached to the wrapped bundle and to a rear face of a second portion of a lid front wall flap, so that the label is lifted when the lid is towards an open position to open the bundle, the method including:

- folding a lid front wall flap against an inner surface of a lid front wall and attaching a first portion of the rear face of the lid front wall flap to said inner surface;
- leaving an intermediate portion of the lid front wall flap that extends from the first portion unattached to the inner surface of the lid front wall;
- folding a second portion of the lid front wall flap that extends from the intermediate portion relative to the intermediate portion to expose a rear face of the lid front wall flap formed by the second portion for attachment of the label to said rear face.

According to another embodiment of the invention, there is provided a blank for forming a package for a group of tobacco industry products wrapped in a barrier material, comprising:

- a lid front wall;
- a lid front wall flap extending from the lid front wall and comprising a first portion, an intermediate portion and a second portion, a fold-line between the lid front wall flap and the lid front wall to enable the lid front wall flap to be folded relative to the lid front wall to enable the first portion of the rear face of the lid front wall flap to be attached to an inner surface of the lid front wall, a fold-line between the intermediate portion and the second portion to enable the second portion to be folded relative to the intermediate portion to expose a rear face of the lid front wall flap formed by the second portion.

The blank may further comprise a fold-line between the first portion and the intermediate portion to enable the intermediate portion to be folded relative to the first portion.

BRIEF DESCRIPTION OF THE DRAWINGS

So that the invention may be more fully understood, embodiments of the invention will now be described, by way of example only, with reference to the accompanying drawings, in which.

DETAILED DESCRIPTION

Figure 1:
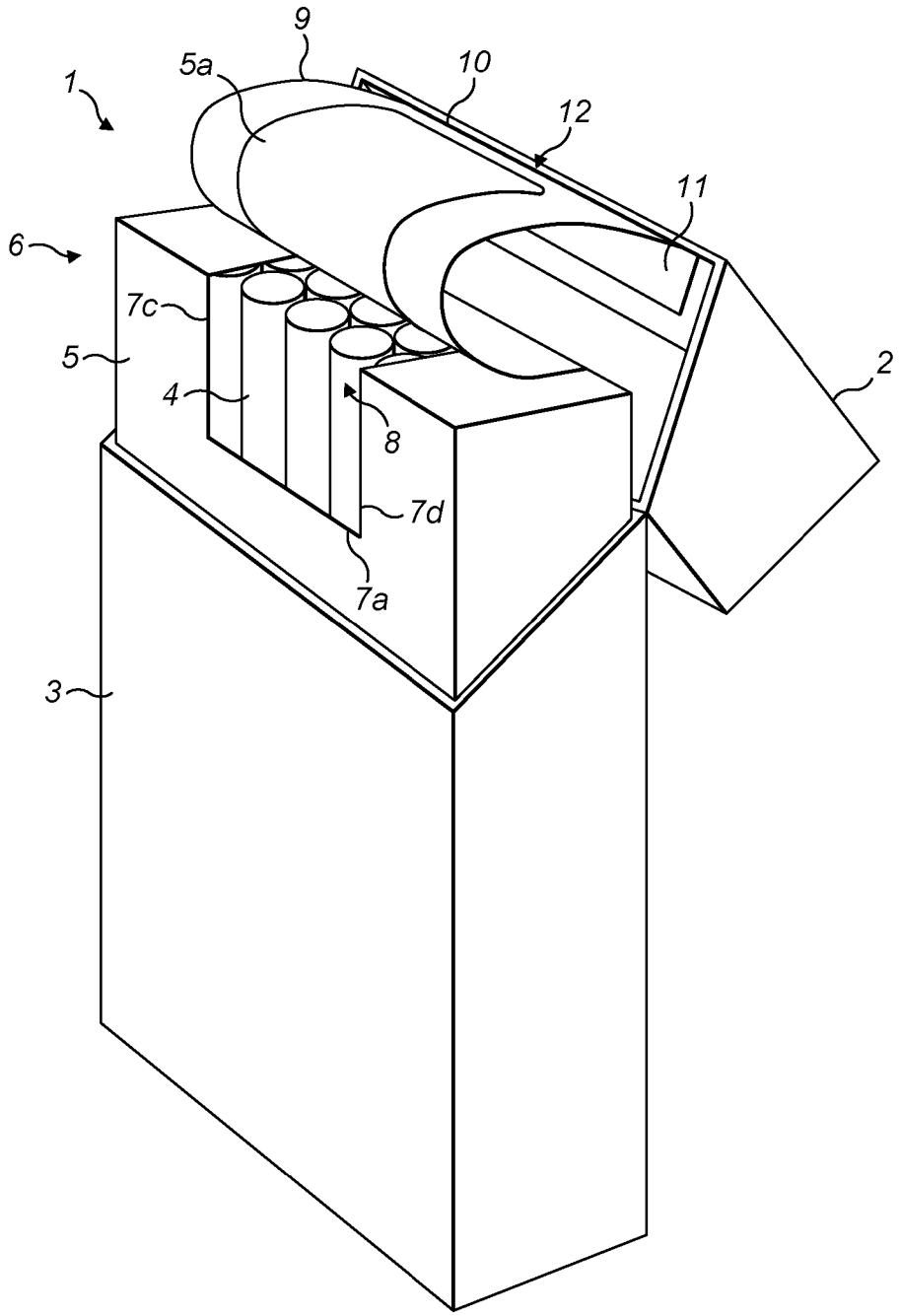
FIG. 1 shows a perspective view of a known pack.

FIG. 1 shows a general embodiment of a rigid card pack 1 with a hinged lid 2 and a base 3 containing a group of cigarettes 4, wrapped in a flexible barrier layer 5 to form a bundle 6. The bounds or edges 7 of an extraction opening 8 are formed from a removable section 5*a* of the barrier layer 5 for allowing access to the cigarettes 4. The extraction opening 8 extends across the top of the bundle 6 and down the front to a lower front wall extraction opening edge 7*a*. The barrier layer 5, which wraps about the cigarettes 4, may be made of metallized plastics or of a plastics/metal foil laminate material.

A label 9 lies over, and is attached to, the removable section 5*a*. The label 9 has, on its undersurface facing the barrier layer 5, a re-stick adhesive applied to it. The re-stick adhesive is of a strength that prevents the label 9 and removable section 5*a* separating when the lid is rotated between open and closed positions. Alternatively, a permanent bonding adhesive may be applied to the portion of the undersurface of the label 9 that overlies the removable region 5*a* of the barrier layer 5. However, a peripheral edge of the label 9, where it extends beyond the edges 7 of the extraction opening 8, has re-stick adhesive applied to it. However, in some embodiments, the label 9 may not extend over the side edges 7*c*, 7*d* of the extraction opening 8. The label 9 may be a flexible label.

The label 9 has a lower front wall edge 10 and may include a tab 11 extending from the lower front wall edge 10. The tab 11 is adhered to an inside surface of the lid 2, as will be described in more detail hereinafter. The tab 11 may either be adhered to the lid 2 without being folded or being folded such that it faces the remainder of the label 9 when the lid 2 is closed. Preferably, the tab 11 is not folded so an inner surface of it faces the bundle and an outer surface faces, and is attached to, the lid. The tab 11 may be separated from the remainder of the label 9 by a fold-line 12 so that the tab rotates relative to the remainder of the label 9 about the fold-line 12 as the lid 2 is rotated between its open and closed positions.

To achieve simultaneous opening of the lid 2 and the extraction opening 8, a portion of the label 9 adjacent to its lower front wall edge 10 is adhered to an inner surface of the lid 2.

The edges 7 of the extraction opening 8 which separate the removable section 5*a* from the remainder of the barrier layer 5 may be defined by lines of weakening in the barrier material or by actual cuts. When the lid 2 is pivoted about a hinge 2*a* into its open position, the label 9 is also pulled due to the connection between the tab 11 and the lid 2 and is peeled back. The removable section 5*a* of the barrier layer 5 remains adhered to the underside of the label 9 and is separated from the remainder of the barrier layer 5 along the lines of weakening or cuts to open the extraction opening 8.

The extraction opening 8 may be closed by pivoting the lid 2 back about the hinge 2*a* into the closed position so that the label rolls back and the removable section 5*a* of the barrier layer 5 re-positions itself within the extraction opening 8. The re-stick adhesive coating the peripheral edge of the label 9 re-adheres to the barrier layer surrounding the extraction opening 8, to reseal the pack 1.

Figure 2:
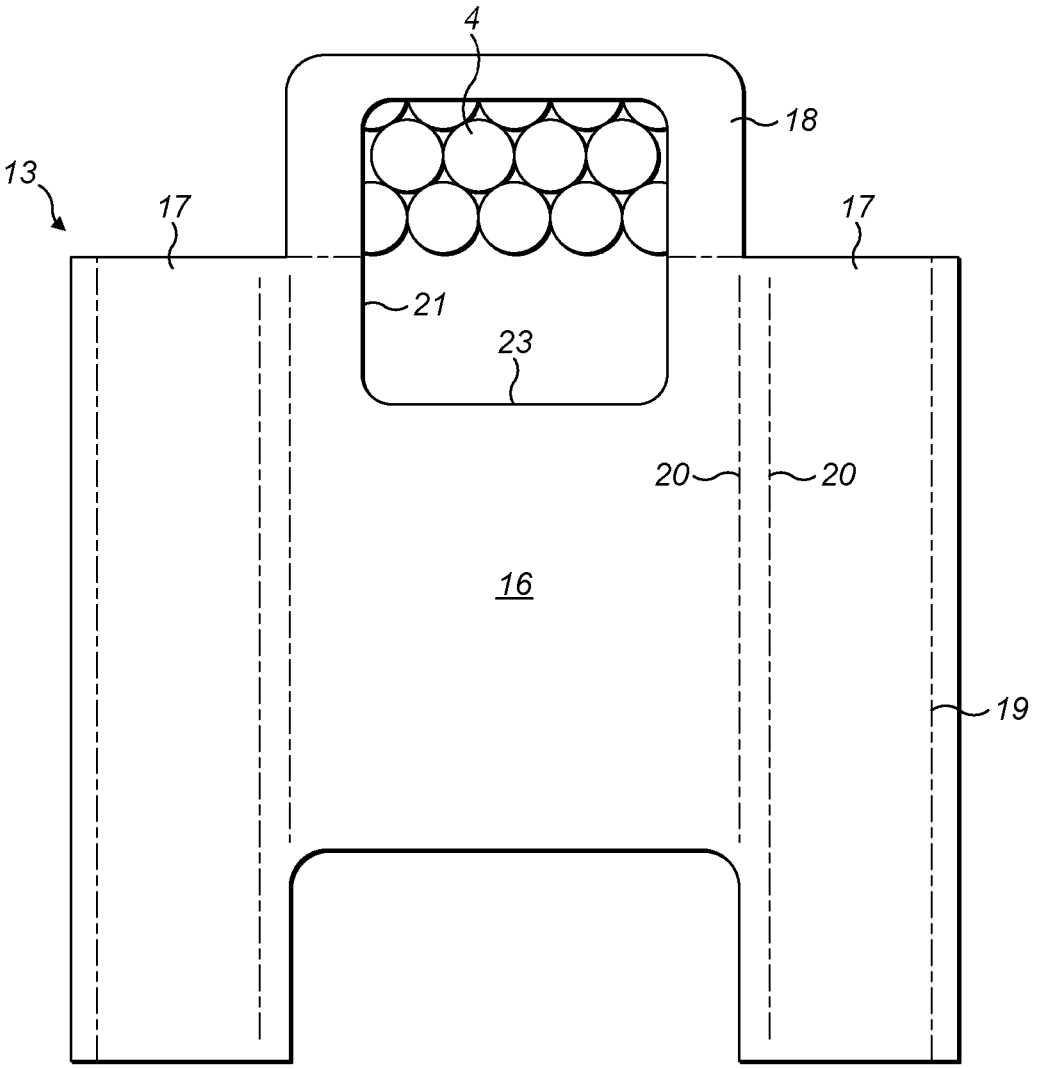
FIG. 2 shows view of a blank of a known inner frame of a pack.
Figure 3:
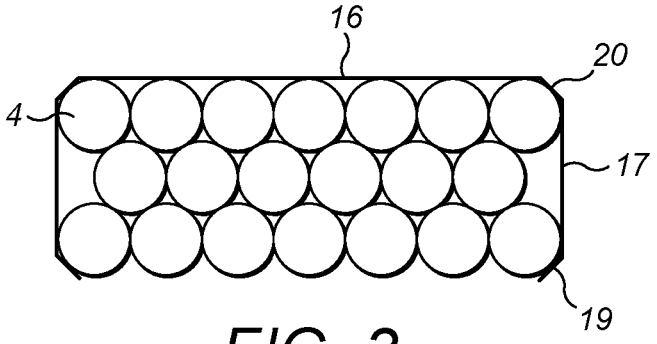
FIG. 3 shows a top view of the blank shown in FIG. 2 wrapped partially around smoking articles.

To ensure good adhesion, an inner frame 13, as shown in FIGS. 2 and 3, may be provided within the bundle 6 so that it extends partially around the cigarettes 4 beneath the barrier layer 5. The inner frame 13 provides a reaction surface underneath the barrier layer 5 against the resealing pressure exerted by the label 9 around the periphery of the extraction opening 8. As shown in FIG. 2, the inner frame 13, which may be made of card, has a front panel 16, two side flaps 17, and top flap 18. Score or fold lines 19, 20 form corners as seen in FIG. 3 when the wings 17 are folded to right angles with the panel 16. Top flap 18 is also folded to right angles. It can be seen that when the inner frame 13 has been folded there is an aperture 21 formed, which corresponds to the extraction opening 8, and through which cigarettes are accessible, as indicate din FIG. 2. The aperture 21 extends to a base edge in the front panel 16.

Referring now to FIGS. 4 to 9, a first embodiment of the pack 30 according to the present invention is shown. The first embodiment of the pack 30 differs from the pack 1 described with reference to FIGS. 1 to 3 with respect to the lid, and the way in which the flexible label is adhered to the lid, as will be described in more detail hereinafter.

Figure 4:
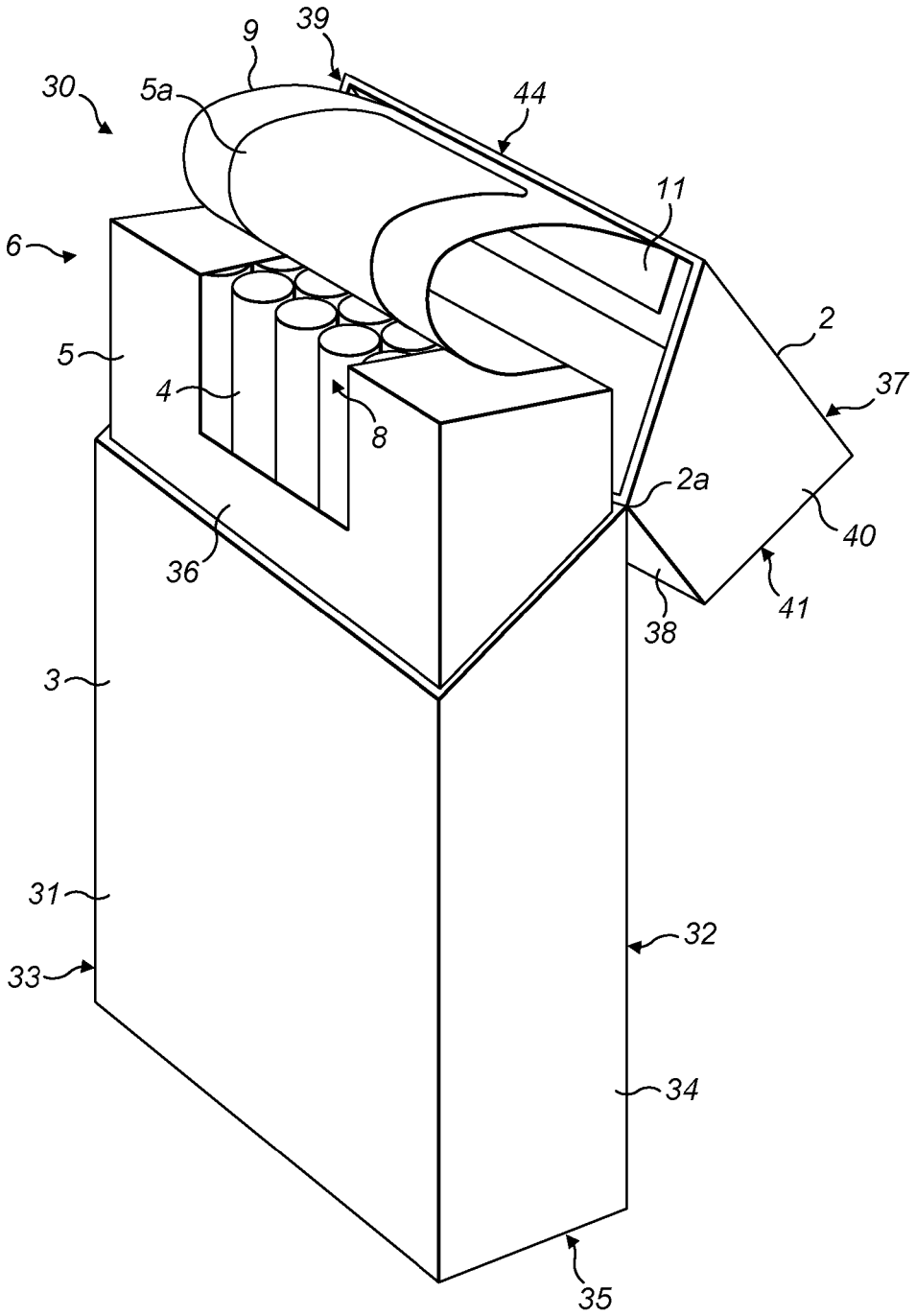
FIG. 4 shows a schematic perspective view of a pack according to a first embodiment of the present invention.

Referring to FIG. 4, the pack 30 comprises a base 3 which has front and rear walls 31, 32 separated by side walls 33, 34 and a bottom wall 35. The top of the base 3 is open ended. The base 3 contains a group of tobacco industry products, in this case cigarettes 4, wrapped in a barrier material 5 to form a bundle 6. The bundle 6 has a front wall 36 which is adjacent to the front wall 33 of the base 3 when the bundle 6 is received within the base 3. The pack 30 further comprises a lid 2 having front and rear walls 37, 38 separated by side walls 39, 40 and a top wall 41. The rear wall 38 of the lid 2 is pivotably attached to the rear wall 32 of the base 3 for rotation about a hinge 2*a* so that the lid 2 can be rotated between open and closed positions.

The barrier material 5 of the pack 30 also comprises a removable section 5*a* to define an extraction opening 8 through which the tobacco industry products, such as cigarettes 4, can be removed from the bundle 6 when the lid 2 is in its open position. In some embodiments, however, the removable section 5*a* may be omitted. The pack 30 further comprises a flexible label 9 which is attached to the barrier material 5 of the bundle 6 and extends over the removable section 5*a*, or the extraction opening 8 if no removable section 5*a* is present.

In the present embodiment, the flexible label 9 is permanently attached to the rear wall 32 of the bundle 6 so that the flexible label 9 remains attached to the bundle 6 even when it is lifted away from the extraction opening 8. Furthermore, the flexible label 9 is attached to and extends over the removable section 5*a* of the barrier material 5.

The flexible label 9 is also attached to the front wall 37 of the lid 2. Therefore, when the lid 2 is pivoted into the open position, the flexible label 9 is lifted away from the barrier material 5 of the bundle 6 to reveal the extraction opening 8 in the barrier material 5 of the bundle 6. In embodiments such as the one illustrated in FIG. 4, when the lid 2 is pivoted into the open position, the flexible label 9 also lifts away the removable section 5*a* of the barrier material 5 from the extraction opening 8, as will be explained in more detail hereinafter.

Figure 5:
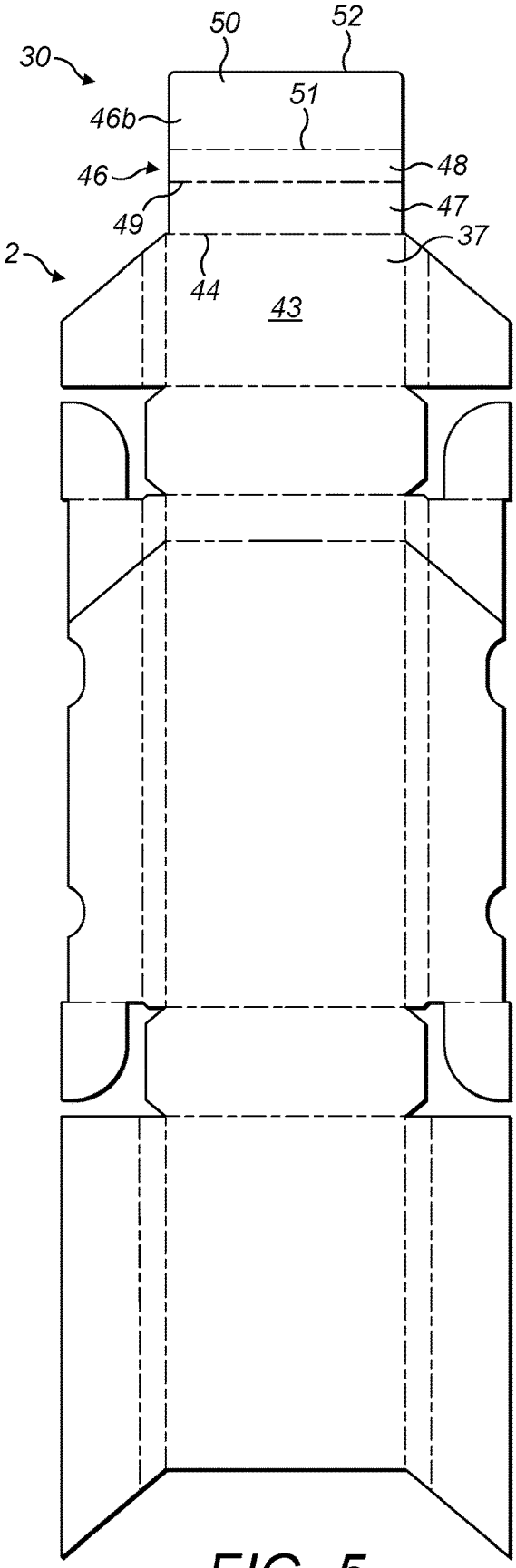
FIG. 5 shows a blank for the first embodiment of the pack shown in FIG. 4.
Figure 6:
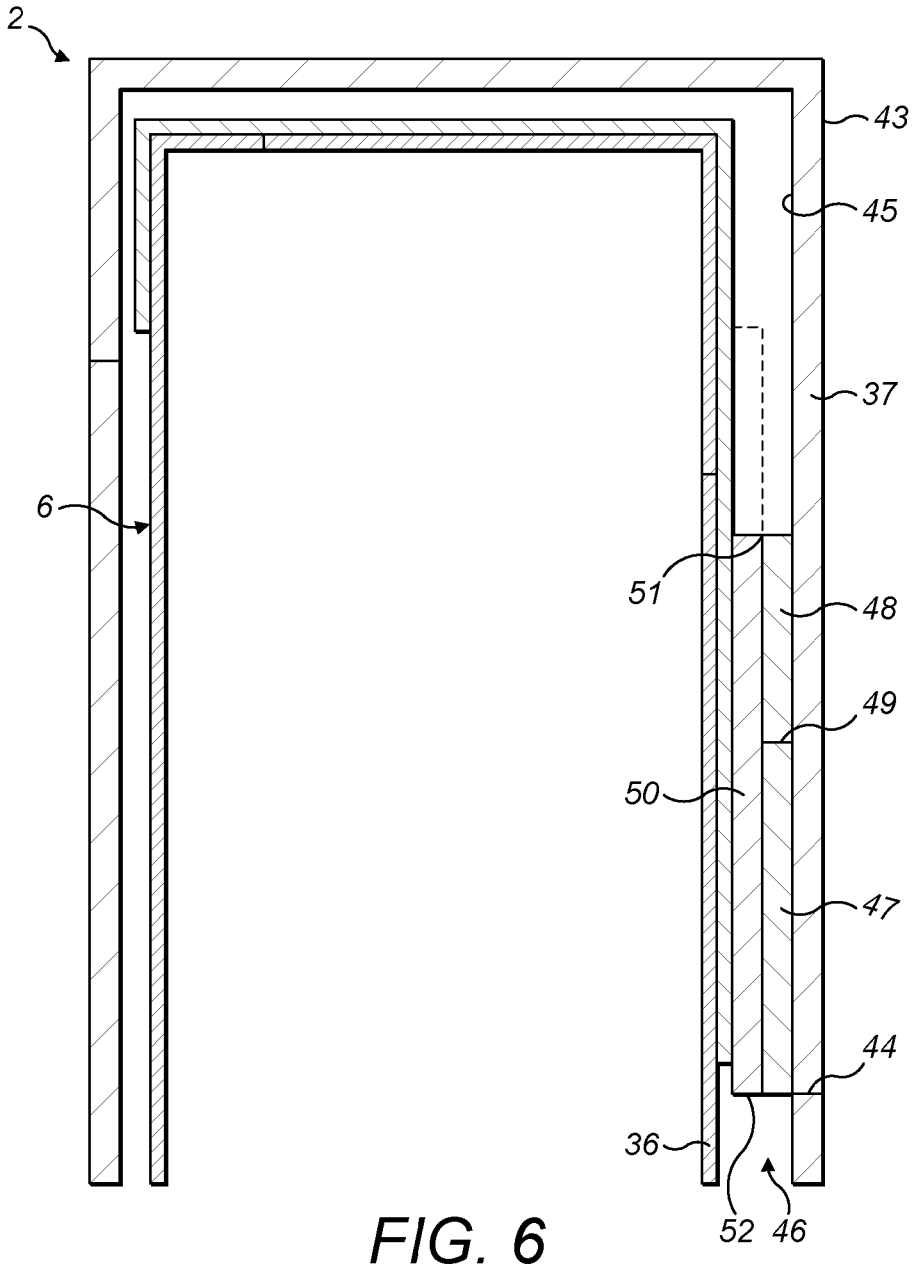
FIG. 6 shows a schematic cross-sectional side view of the pack shown in FIGS. 4 and 5 when the lid is in its closed position.

In the present embodiment, as shown in FIGS. 5 and 6, the lid front wall 37 comprises an external surface 43 which is the only surface of the lid front wall 37 that can be seen when the lid 2 is in its closed position. The lid front wall 37 further comprises a lower front wall edge 44 and an inner surface 45. The lid front wall 37 further comprises a lid front wall flap 46 which comprises front and rear faces. The rear face 46*b* is shown in FIG. 5 and the front face is on the opposing side of the blank of the pack 30. The lid front wall flap 46 is folded relative to the lid front wall 37 about a fold extending along the lower front wall edge 44.

The lid front wall flap 46 comprises a first portion 47 which extends from the fold along the lower front wall edge 44. The first portion 47 is folded back onto the inner surface 45 of the lid front wall 37 and is adhered thereto using permanent adhesive. That is, the rear face 46*b* of the lid front wall flap 46 formed by the first portion 47 is attached to the inner surface 45 of the lid front wall 37. The fold extending along the lower front wall edge 44 may have a line of weakness to assist in folding the first portion 47 back onto the inner surface 45 of the front wall 37.

The lid front wall flap 46 further comprises an intermediate portion 48 extending from the first portion 47. The intermediate portion 48 is foldable relative to the first portion 47 about a fold line 49. The fold line 49 may be formed from a line of weakness to help the intermediate portion 48 fold relative to the first portion 47. In the present embodiment, the fold-line 49 between the first and intermediate portions 47, 48 is formed on first opening of the lid 2, as explained in more detail hereinafter. In other embodiments, the fold-line 49 may be formed prior to the first opening of the lid 2. The fold-line 49 may be formed in the region of the edge of the adhesive adhering the first portion 47 to the inner surface 45 of the lid front wall 37.

The lid front wall flap 46 further comprises a second portion 50. The second portion 50 extends from the intermediate portion 48. The second portion 50 is foldable relative to the intermediate portion 48 about a fold line 51. The second portion 50 is folded back relative to the first portion 47 to expose the rear face 46*b* of the lid front wall flap 46 formed by the second portion 50. The tab 11 of the flexible label 9 is attached to the exposed rear face 46*b* of the lid front wall flap 46 formed by the second portion 50. The second portion 50 lies over the first portion 47 and lies against the front wall 36 of the bundle 6 when the lid 2 is in its closed position. That is, the second portion 50 is between the first and intermediate portions 47, 48, such that the front face of the lid front wall flap 46 formed by the second portion 50 abuts the front face of the lid front wall flap 46 formed by the first and intermediate portions 47, 48 and the rear face of the lid front wall flap 46 formed by the second portion 50 faces the wrapped bundle 6. The fold line 51 may be formed from a line of weakness to help fold the second portion 50 relative to the intermediate portion 48.

The lid front wall flap 46 is configured such that during the initial rotation of the lid 2 from its closed position towards its open position, the intermediate portion 48 folds relative to the first and second portions 47, 50 about fold lines 49, 51. The fold line 49 is formed as the intermediate portion 48 folds relative to the first portion 47 in some embodiments. In other embodiments, the fold line 49 may already be formed before the initial rotation of the lid 2 towards its open position. This means that movement or rotation of the second portion 50 is limited, or prevented, until the intermediate portion 48 has folded relative to the first and second portions 47, 50, as the lid is rotated through an initial angle from its closed position towards its open position. The intermediate portion 48 therefore acts as a buffer to limit or prevent movement of the second portion during initial rotation of the lid 2.

The length of the intermediate portion 48, i.e. the distance between the fold lines 49, 51 is less than the length of the first portion 47 and the second portion 50 extending in the same direction. The length of the intermediate portion 48 is relevant to operation of the lid front wall flap 46, as the intermediate portion 48 allows the lid 2 to rotate from the closed position towards the open position initially without the second portion 50 rotating and being lifted out of contact with the bundle 6. Therefore, when the lid 2 is initially moved from the closed position towards the open position lifting of the flexible label 9 away from the extraction opening 8 is delayed. The longer the intermediate portion 48 is, the further the lid 2 can be moved from its closed position towards its open position before the second portion 50 of the lid front wall flap 46 moves and is lifted out of contact with the bundle 6.

However, the length of the intermediate portion 48 is limited by the space available between the inner surface 45 of the lid 2 and the bundle 6 during initial opening of the lid 2 because if the intermediate portion 48 is too long it cannot fold relative to the first and second portions 47, 50 so the second portion 50 is lifted away from the bundle 6 prematurely. The length of the intermediate portion 48 is also limited by a top edge 53 of the bundle 6 because the fold-line 51 of the intermediate portion 48 must be in contact with the bundle 6 to ensure that the second portion 50 remains in contact with the bundle 6. Once the fold-line 51 of the intermediate portion 48 moves beyond the top edge 53 of the bundle 6 the second portion 50 will lift from the bundle 6 and the flexible label 9 will be lifted with it to reveal the extraction opening 8.

As illustrated in FIG. 6, the intermediate portion 48 lies in the same plane as the first portion 47 when the lid 2 is in its closed position. Consequently, when the lid 2 is in the closed position, the intermediate portion 48 abuts the inner surface 45 of the front wall 37 of the lid 2 and the second portion 50. That is, one surface of the intermediate portion 48 abuts the inner surface 45 of the front wall 2 of the lid 2 when the lid 2 is in its closed position and the opposite surface of the intermediate portion 48 abuts the second portion 50 when the lid 2 is in its closed position.

In the present embodiment, the length of the second portion 50 is equal to the combined length of the first portion 47 and the intermediate portion 48. Therefore, when the lid 2 is in the closed position, the free end 52 of the second portion 50 is adjacent to the lower front wall edge 44 of the front wall 37 of the lid 2 and thus, next to the top edge of the front wall 31 of the base 3.

Figure 7:
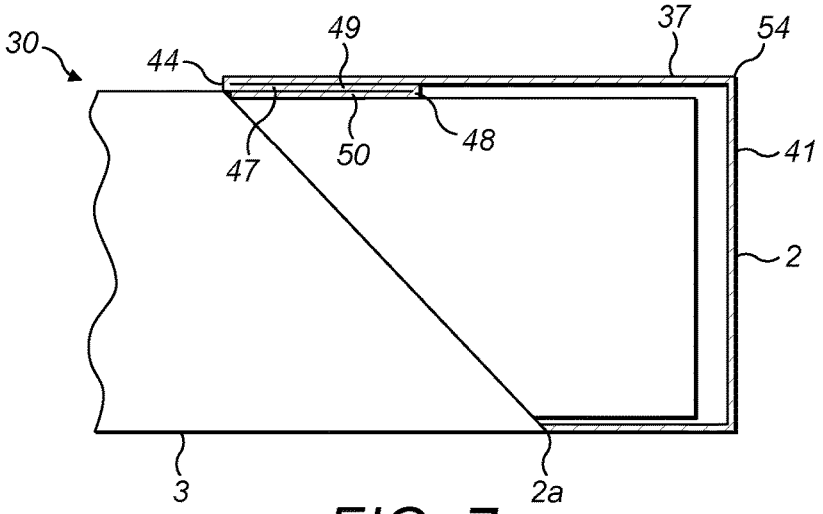
FIG. 7 shows a schematic cross-sectional side view of the pack shown in FIGS. 4 and 5 when the lid is in its closed position.
Figure 8:
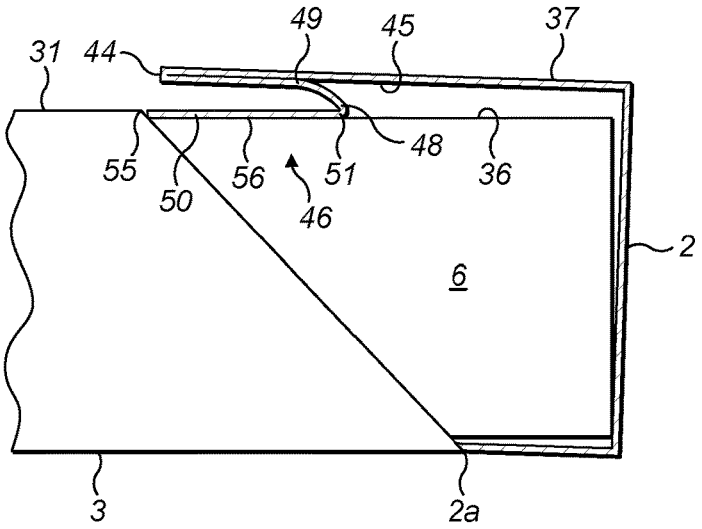
FIG. 8 shows a schematic cross-sectional side view of the pack shown in FIGS. 4 and 5 after initial opening of the lid.

Operation of the pack 30 will now be described with reference to FIG. 7 to 9. When a consumer desires to open a closed pack 30, they place a finger on the lid 2 of the pack and rotate it from its closed position towards its open position about the hinge 2*a* joining the lid 2 and the base 3. Usually, the consumer will place their finger on the lid front wall 37 proximate to the top wall 41 of the lid 2. Therefore, the initial moment arm is equal to the distance between the hinge 2*a* and the top wall 41 of the lid 2. As the consumer continues to rotate the lid 2 towards its open position, the moment arm increases as an edge 54 connecting the front and top walls 37, 41 of the lid moves horizontally further away from the hinge 2*a*.

The lid front wall 37 is also rotated away from the front wall 36 of the bundle 6 such that the lower front wall edge 44 of the lid front wall 37 is rotated away from the top edge 55 of the front wall 31 of the base 3. However, the flexible label 9 which is attached to the lid 2 is not lifted away from the bundle 6 or the extraction opening 8. Instead, during the initial opening of the lid 2, the rear face 46*b* of the lid front wall flap 46 formed by the second portion 50 of the lid front wall flap 46 abuts the front wall 36 of the bundle 6, and as the lid 2 is rotated about the hinge 2*a* towards its open position, the intermediate portion 48 is rotated away from the inner surface 45 of the front wall of the lid 2.

More specifically, during initial opening of the lid 2, the second portion 50 has its centre of rotation at the fold-line 51 of the intermediate portion 48, instead of the hinge 2*a*, and the second portion 50 is not rotated about this fold-line 51 away from the bundle 6 because of the folds formed in the edges 49, 51 of the first and intermediate portions 47, 48. As the lid 2 is moved from its closed position towards its open position, the intermediate portion 48 is rotated away from the inner surface 45 of the front wall 37 of the lid 2 such that the angle between the first portion 47 and the intermediate portion 48 decreases and the angle between the intermediate portion 48 and the second portion 50 increases, as shown in FIG. 8.

Figure 9:
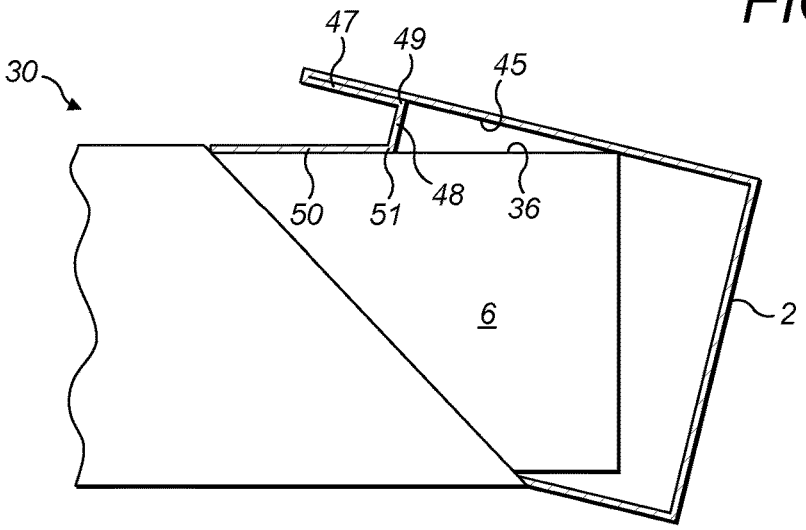
FIG. 9 shows a schematic cross-sectional side view of the pack shown in FIGS. 4 and 5 when the lid has been rotated towards its open position.

The intermediate portion 48 continues to rotate about the fold-line 49 of the first portion 47 until it is perpendicular to the first portion 48, as shown in FIG. 9. At this stage, the perpendicular distance from the plane of the first portion 47 between the inner surface 45 of the lid 2 and the front wall 36 of the bundle 6 is greater than the length of the intermediate portion 48. At this point, the second portion 50 begins to be lifted out of contact with the front wall 36 of the bundle 6. Any resilience in the fold 51 may mean that the free end 52 of the second portion 50 is the last part of the lid front wall flap 46 to be lifted from contact with the bundle 6. However, any movement of the fold-line 51 of the intermediate portion 48 away from the bundle 6 will begin to remove the flexible label 9 away from the extraction opening 8. By the time that the second portion 50 begins to be rotated and lifted out of contact with the front wall of the bundle 6, the lid 2 has been rotated in the range of 10 to 60 degrees from its closed position.

As the consumer continues to rotate the lid 2 towards its open position, the second portion 50 is rotated with the lid 2 and flexible label 9 is lifted away from the bundle 6 to reveal the extraction opening 8. As the flexible label 9 is peeled away from the extraction opening 8, the flexible label 9 is folded back on itself twice so as to form a 'Z-shape'. Such 'Z-ing' of the flexible label 9 near its lower front wall edge 10 creates a resistance to opening of the pack 30. However, the present invention helps to overcome such resistance by increasing the moment arm between the edge 54 on which the user pushes to open the lid 2 before the 'Z-ing' of the flexible label 9 occurs. Thus, the force required by the user to overcome the 'Z-ing' is less and the pack 30 is easier to open.

It is understood that some consumers prefer to open the pack 30 by pushing the lower front wall edge 44 of the lid front wall 37 away from the top edge 55 of the front wall 31 of the base 3. It will be understood that, the moment arm between the lower front wall edge 44 and the hinge 2*a* will also be increased before the flexible label 9 is lifted from the extraction opening 8 and therefore, before 'Z-ing' occurs so that less force is required by the user to open the pack 30. In some embodiments, to ensure that a consumer opening the pack 30 from the lower front wall edge 44 of the lid 2 does not accidentally contact the second portion 50 when opening the lid 2, the lid front wall 37 may be extended so that it is longer than in a standard pack. In such embodiments, the lower front wall edge 44 and the free end 52 of the second portion 50 will not be adjacent to each other when the lid 2 is in the closed position. In fact, the free edge 52 will be further from the top edge 55 of the front wall 31 of the base 3 than the lower front wall edge 44 of the lid front wall 37.

Referring now to FIGS. 10 to 13, a second embodiment of the pack 60 according to the present invention is shown. The pack 60 shown in FIGS. 10 to 13 is generally the same as the first embodiment of the pack 30 described above and so a detailed description will be omitted herein. Furthermore, features and components of the pack 60 that are the same as features and components of the pack 30 will retain the same terminology and reference numerals. However, the second embodiment of the pack 60 differs from the first embodiment of the pack 30 in that the lid front wall flap 46 of the lid 2 has been modified.

Figure 11:
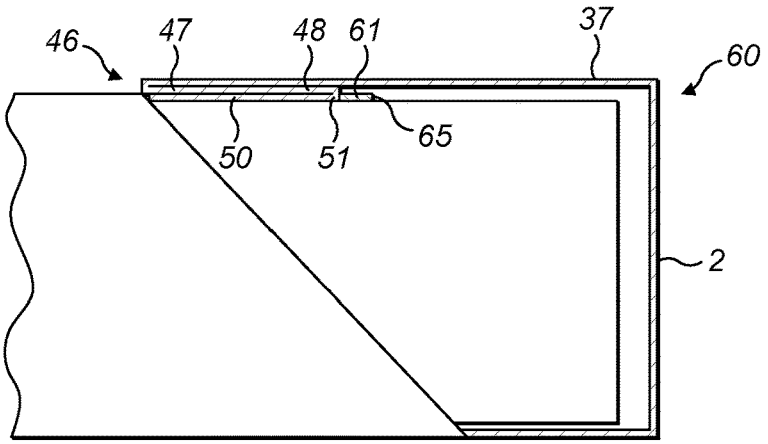
FIG. 11 shows a cross-sectional side view of the pack shown in FIGS. 4 and 10 when the lid is in its closed position.

In the present embodiment, shown in FIG. 11, the lid front wall flap 46 of the front wall 37 further comprises a tongue 61. More specifically, the second portion 50 of the lid front wall flap 46 comprises the tongue 61. The tongue 61 extends from the second portion 50 into the intermediate portion 48. In the present embodiment, the tongue 61 extends substantially in the same plane as the second portion 50 of the lid front wall flap 46. Thus, the tongue 61 extends in the opposite direction to the second portion 50 3*o* which extends from the fold-line 51 of the intermediate portion 48.

Figure 10:
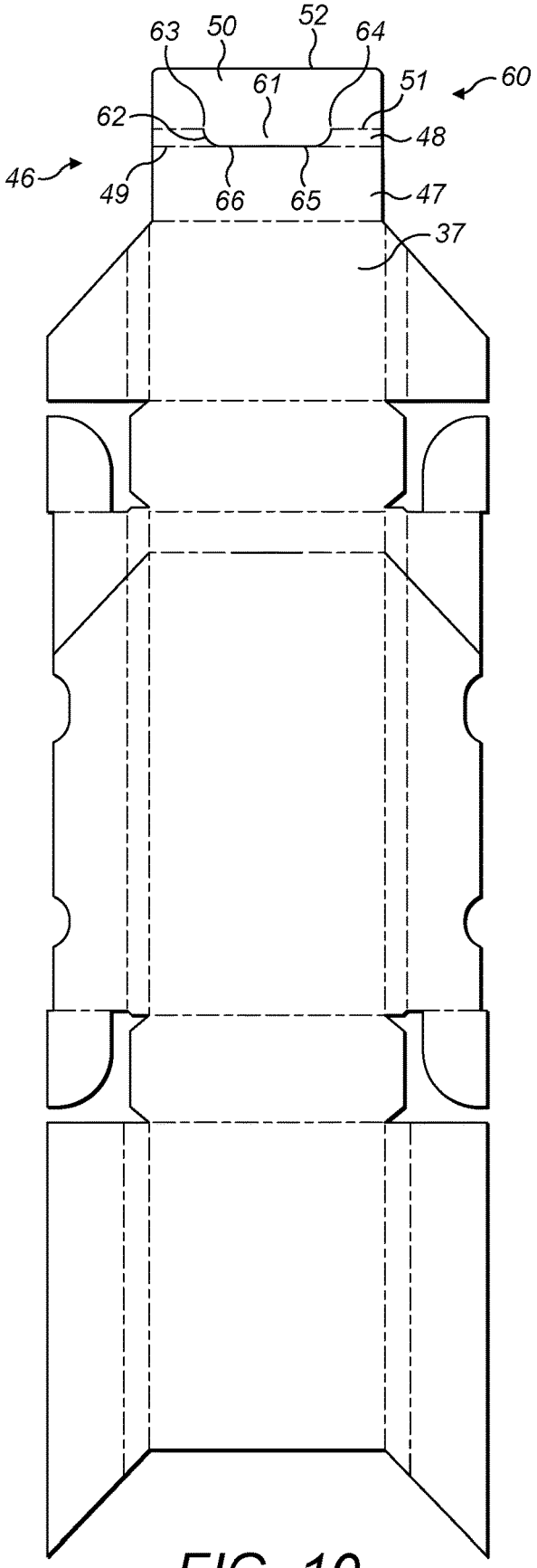
FIG. 10 shows a blank for a second embodiment of the pack shown in FIG. 4.

As shown in FIG. 10, the tongue 61 is formed from a cut 62 through the intermediate portion 48 to form a U-shaped flap. The cut 62 has two opposing ends: a first end 63 or beginning of the cut 62 and a second end 64 or end of the cut 62. Both the first and second ends 63, 64 are located at the fold-line 51 of the intermediate portion 48 and extend into the intermediate portion 48. In the present embodiment, the cut 62 extends from the first and second ends 63, 64 towards the fold-line 49 of the first portion 47 on the opposite side of the intermediate portion 48. However, it will be understood, that in alternative embodiments, the cut 62 may initially extend in a different direction before extending towards the fold-line 49 of the first portion 47.

The length of the tongue 61 is defined as the distance from the fold-line 51 of the intermediate portion 48, from which the second portion 50 extends, to a free end 65 of the tongue 61, which is perpendicularly furthest from the fold-line 51. In the present embodiment, the cut 62 is configured such that the tongue 61 is the same length as the intermediate portion 48. That is, a middle portion 66 of the cut 62, located between the first and second ends 63, 64 along the cut 62, forms the free end 65 of the tongue 61 and the free end 65 extends at least partially along the fold line 51 of the intermediate portion 48. As can be seen from FIG. 10, the cut 62 is generally 'U-shaped'. However, it will be appreciated that the cut 62 may be alternatively shaped.

The tongue 61 is configured to resist rotation of the second portion 50 during the initial movement of the lid 2 from its closed position towards its open position. Therefore, the tongue 61 enables the lid 2 to be rotated further towards its open position, from its closed position, before the second portion 50 is rotated or begins to be lifted out of contact with the front wall 36 of the bundle 6 in the base 3, when compared to the first embodiment of the pack 30 shown in FIGS. 4 to 9.

Thus, the operation of the pack 60 is the same as described above for the pack 30 except for the fact that the second portion 50 has its centre of rotation at the free end 65 of the tongue 61 of the second portion 50 instead of fold-line 51 of the intermediate portion 48 or the hinge 2*a*.

Therefore, as the lid 2 is moved from its closed position towards its open position, the intermediate portion 48 is rotated away from the inner surface 45 of the lid front wall 37 such that the angle between the first portion 47 and the intermediate portion 48 decreases and the angle between the intermediate portion 48 and the second portion 50 increases.

Figure 12:
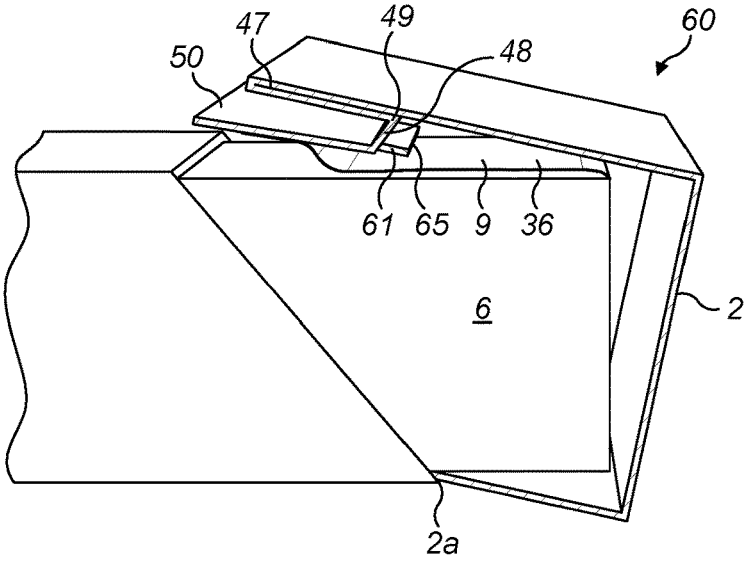
FIG. 12 shows a cross-sectional side view of the pack shown in FIGS. 4 and 10 when the lid has been rotated towards its open position.

As a result, when the lid 2 is rotated such that the intermediate portion 48 is rotated about the fold-line 49 of the first portion 47 so that the angle between the first and intermediate portions 47, 48 passes the perpendicular, the second portion 50 is not lifted out of contact with the front wall 36 of the bundle 6, as shown in FIG. 12, because the free end 65 of the tongue 61 is still in contact with the bundle 6. As the lid 2 is rotated further, the tongue 61 of the second portion 50 prevents the second portion 50 from being lifted out of contact with the bundle 6. Instead, the free end 65 of the tongue 61 forms a pivot point about which the second portion 50 must rotate before being lifted out of contact with the bundle 6.

Figure 13:
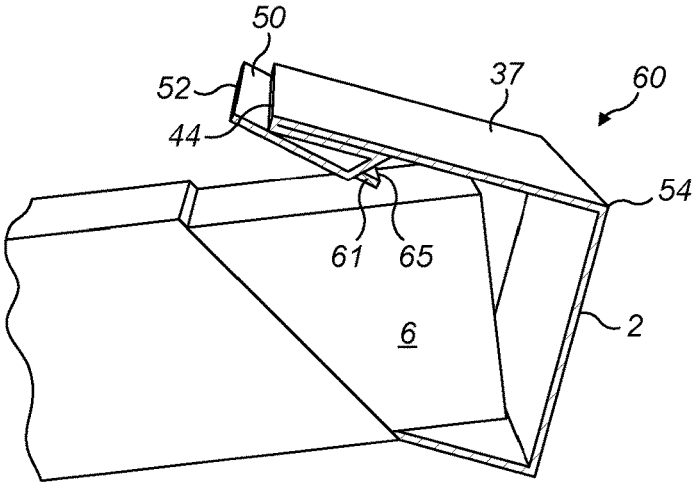
FIG. 13 shows a cross-sectional side view of the pack shown in FIGS. 4 and 10 when the lid has been rotated towards its open position.

As the second portion 50 pivots about the free end 65 of the tongue 61, it lifts the flexible label 9, or more specifically, the tab 11 of the flexible label 9 that does not have any adhesive on it, away from the rest of the bundle 6. The second portion 50 pivots about the free end 65 of the tongue 61 until a portion of the second portion 50 proximate the free end 52 of the second portion 50 abuts the lower front wall edge 44 of the lid front wall 37, as shown in FIG. 13. Eventually, when the lid 2 is rotated far enough from the closed position towards the open position, the free end 65 of the tongue 61 is lifted out of contact with the bundle 6.

By pivoting the second portion 50 about the free end 65 of the tongue 61 before the second portion 50 if lifted out of contact with the bundle 6, the lid 2 can be rotated further from the closed position towards the open position and so the moment arm of the edges 54, 55 is increased, compared with the first embodiment of the pack 30, so that less force is required from the user to overcome the resistance to opening caused by 'Z-ing' of the flexible label 9.

The force exerted by the flexible label 9, due to the re-stick adhesive on the underside of the flexible label 9 which adheres the label 9 to the barrier material 5 of the bundle 6, also acts substantially perpendicularly to the plane in which the second portion 50 extends during opening the lid 2. This is the direction in which glue withstands forces best and so helps to reduce the likelihood of the glue failing through multiple openings of the lid 2.

Figure 14:
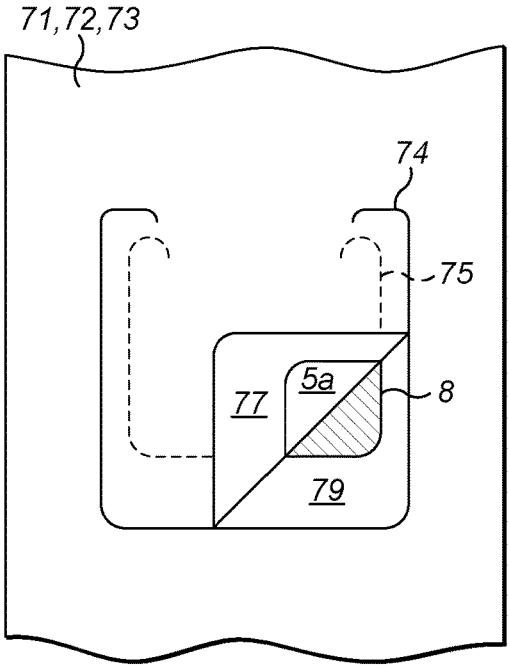
FIG. 14 shows a plan view of a label where the label and barrier material are formed by a multi-layer laminate.
Figure 15:
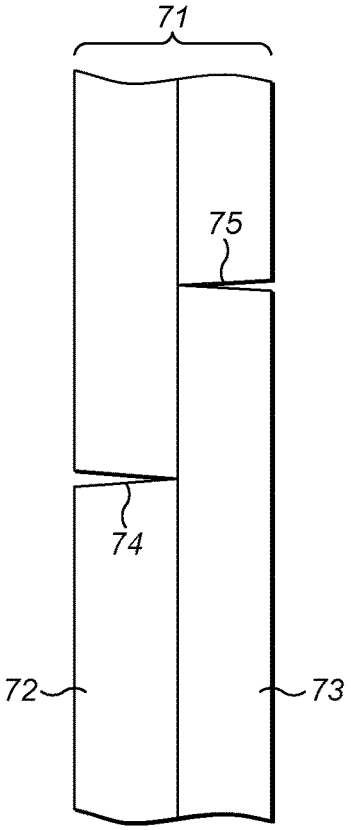
FIGS. 15 and 16 show partial cross-sections of the label and barrier of FIG. 14 made from different laminates.

In one embodiment of the present invention, the flexible label 9 and the barrier layer 5 may be made from the same laminate material. For example, referring to FIGS. 14 and 15, a laminate 71 has an outer layer 72 having a first cut 74 that defines an outer layer region 77 bounded by the first cut 74 and an inner layer 73 having a second cut 75 that defines and inner layer region 78 bounded by the second cut 75. The inner layer region 78 lies within the outer layer region 77. A part of the outer layer region 77 is attached to an inner surface of the lid 2 such that as the lid 2 is rotated into its open position, the inner and outer layer regions 78, 77 are lifted causing the inner and outer layers 78, 72 to delaminate in a peripheral region 79 between the first and second cuts 74, 75 and the extraction opening 8 that is created in the laminate.

Figure 16:
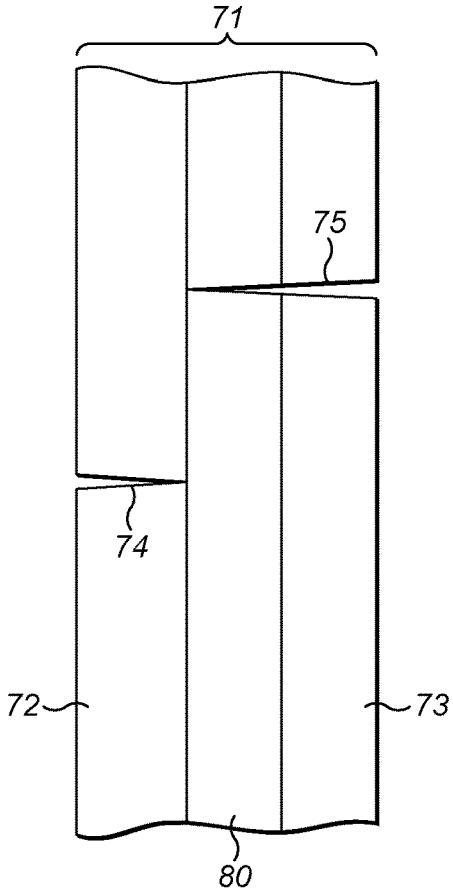

FIG. 16 shows a further example of a laminate material as described above but having three layers instead of two. In this example, the outer layer 72 and a third layer 80 are bonded using a pressure-sensitive 're-stick' adhesive, and the inner layer 73 and the third layer 80 are bonded using a permanent adhesive. In this case, the first cut 74 is provided in the outer layer 72 and the second cut 75 is provided in the inner layer 73 and in the third layer 80. The first and second cuts 74, 75 are offset.

In an alternative example similar to that of FIG. 16, the outer layer 72 and the third layer 80 are permanently bonded together, and the inner layer 73 and the third layer 80 are bonded together using pressure-sensitive adhesive. In this case, the first cut 74 is provided in the outer layer 72 and in the third layer 80 and the second cut 75 is provided in the inner layer 73. It will be appreciated that the laminate material 71 may have more than three layers bonded together in a similar manner to that described above, with the first and second cuts 74, 75 each provided in one or more layers. It can be envisaged that integral label and barrier examples can be combined with any of the previously described embodiments.

As used herein, the term "tobacco industry product" is to be understood as including smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products; and hybrid systems to generate aerosol from a combination of substrate materials, for example hybrid systems containing a liquid or gel or solid substrate.

In one embodiment, the tobacco industry product is a smoking article for combustion selected from the group consisting of a cigarette, a cigarillo and a cigar.

In one embodiment, the tobacco industry product is a non-combustible smoking article.

In one embodiment the tobacco industry product is a heating device which releases compounds by heating, but not burning, a substrate material. The material may be for example tobacco or other non-tobacco products, which may or may not contain nicotine. In one embodiment the heating device is a tobacco heating device.

In another embodiment the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

Embodiments of the invention are described with reference to tobacco industry products, for example cigarettes. However, it will be appreciated that packs of the invention may alternatively be used for non-tobacco industry related products.

In order to address various issues and advance the art, the entirety of this disclosure shows by way of illustration various embodiments in which the claimed invention(s) may be practiced and provide superior packs for tobacco industry products. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A pack comprising:

a base containing a group of tobacco industry products wrapped in a barrier material that comprises a removable section to define an extraction opening for the removal of tobacco industry products;

a lid attached to the base for rotation between an open position and a closed positions and comprising a lid front wall having an inner surface and a lid front wall flap having a front face and a rear faces, the lid front wall flap being folded relative to the lid front wall about a fold along a lower edge of the lid front wall, the lid front wall flap comprising a first portion extending from said fold, the rear face of the lid front wall flap formed by the first portion being attached to said inner surface of the lid front wall, the lid front wall flap also comprising an intermediate portion extending from, and which is configured to fold relative to, the first portion, and a second portion extending from the intermediate portion which is folded relative to the intermediate portion to expose the rear face of the lid front wall flap formed by the second portion, a label attached to the removable section of the barrier material and to the lid so that, when the lid is rotated towards the open position, the removable section is lifted to open the extraction opening;

wherein the label is attached to the rear face of the lid front wall flap formed by the second portion.

2. The pack according to claim 1, wherein the first, intermediate, and second portions of the lid front wall flap are integrally formed, the intermediate portion being separated from the first and second portions by a corresponding first fold-line and a second fold-line.

3. The pack according to claim 2, wherein each of the first and second fold-lines are parallel, and parallel to a fold about which the lid rotates between the open position and the closed positions.

4. The pack according to claim 2, wherein a height of the intermediate portion is less than a height of the first portion or less than a height of the second portions, extending in a direction between the first and second fold lines.

5. The pack according to claim 2, wherein the intermediate portion extends from the first portion and lies against the inner surface of the lid when the lid is in the closed position.

6. The pack according to claim 5, wherein the second portion is between the first and intermediate portions, and the wrapped bundle, when the lid is in the closed position, such that the front face of the lid front wall flap formed by the second portion abuts the front face of the lid front wall flap formed by the first and intermediate portions and the rear face of the lid front wall flap formed by the second portion faces the wrapped bundle.

7. The pack according to claim 2, further comprising a tongue cut from the intermediate portion and extending from the second portion such that the tongue remains in a plane of the second portion upon folding of the intermediate portion relative to the second portion upon initial opening of the lid.

8. The pack according to claim 7, wherein the tongue is cut from the intermediate portion so that it extends for only part of the height of the intermediate portion extending in a direction between the fold lines.

9. The pack according to claim 7, wherein the tongue is cut from the intermediate portion so that it extends for the full height of the intermediate portion and divides the intermediate portion into two sections separated by the tongue.

10. The pack according to claim 7, wherein the cut is U-shaped.

11. The pack according to claim 1, wherein a free edge of the second portion is spaced from the lower edge of the lid front wall in a direction extending in a plane of the lid front wall when the lid is in the closed position.

12. The pack according to claim 1, comprising a line of weakness between the removable section and the remainder of the barrier layer that breaks when the lid is rotated into the open position.

13. The pack according to claim 12, wherein the label has a peripheral edge that extends beyond the removable section to overlap the barrier layer surrounding the removable section, the peripheral edge being adhered to the barrier layer with re-stick adhesive.

14. The pack according to claim 13, wherein the barrier material is a multi-layered laminate material and the label is formed from a layer of the multi-layered laminate material.

15. The pack according to claim 1, wherein the base and lid are integrally formed from a foldable board material.

16. A method of packaging a wrapped bundle of tobacco industry products in a container that comprises a base and a lid, and in which a label is attached to the wrapped bundle and to a rear face of a second portion of a lid front wall flap, so that the label is lifted when the lid is rotated towards an open position to open the bundle, the method including:

folding a lid front wall flap against an inner surface of a lid front wall and attaching a first portion of the rear face of the lid front wall flap to said inner surface;

leaving an intermediate portion of the lid front wall flap that extends from the first portion unattached to the inner surface of the lid front wall;

folding a second portion of the lid front wall flap that extends from the intermediate portion relative to the intermediate portion to expose a rear face of the lid front wall flap formed by the second portion for attachment of the label to said rear face.

17. A blank for forming a package for a group of tobacco industry products wrapped in a barrier material, comprising:

a lid front wall;

a lid front wall flap extending from the lid front wall and comprising a first portion, an intermediate portion and a second portion, wherein the intermediate portion is connected to both the first and second portions, and the second portion has a tongue formed from the intermediate portion and has a free end, a fold-line between the lid front wall flap and the lid front wall to enable the lid front wall flap to be folded relative to the lid front wall to enable a rear face of the first portion of the lid front wall flap to be attached to an inner surface of the lid front wall, and a fold-line between the intermediate portion and the second portion to enable the second portion to be folded relative to the intermediate portion to expose a rear face of the second portion of the lid front wall flap.

18. The blank for forming a package for a group of tobacco industry products wrapped in a barrier material according to claim 17, further comprising a fold-line between the first portion and the intermediate portion to enable the intermediate portion to be folded relative to the first portion.

* * * * *